US006705788B2

(12) United States Patent
Gadberry

(10) Patent No.: US 6,705,788 B2
(45) Date of Patent: Mar. 16, 2004

(54) HAND SUPPORT AND WRITING INSTRUMENT HOLDER

(76) Inventor: Laura J. Gadberry, 7912 79th Way, West Palm Beach, FL (US) 33407

( * ) Notice: Subject to any disclaimer, the term of this patent is extended or adjusted under 35 U.S.C. 154(b) by 74 days.

(21) Appl. No.: 10/194,712

(22) Filed: Jul. 12, 2002

(65) Prior Publication Data

US 2004/0009027 A1 Jan. 15, 2004

(51) Int. Cl.[7] ..... A46B 5/02; B43K 3/00
(52) U.S. Cl. ..... 401/6; 401/8; 15/443
(58) Field of Search ..... 401/6–8; 15/443

(56) References Cited

U.S. PATENT DOCUMENTS

| | | | | | |
|---|---|---|---|---|---|
| 880,510 | A | * | 3/1908 | Delshaw | 15/443 |
| 1,336,432 | A | * | 4/1920 | Henry | 15/437 |
| 1,342,576 | A | * | 6/1920 | Wride | 401/6 |
| 4,165,896 | A | * | 8/1979 | Hunt | 294/25 |
| 4,602,885 | A | * | 7/1986 | Bischoff et al. | 401/6 |
| 4,917,517 | A | * | 4/1990 | Ertz | 401/6 |
| 4,944,766 | A | * | 7/1990 | Williams | 623/65 |
| 4,957,442 | A | * | 9/1990 | Prater | 434/166 |
| 5,180,239 | A | * | 1/1993 | Bistrack | 401/6 |
| 5,320,438 | A | * | 6/1994 | Yang | 401/6 |
| 5,542,588 | A | * | 8/1996 | Sison | 224/218 |
| 5,626,430 | A | * | 5/1997 | Bistrack | 401/6 |
| 5,722,575 | A | * | 3/1998 | Smith | 224/217 |
| 6,161,974 | A | * | 12/2000 | Nakagawa | 401/6 |
| 6,254,293 | B1 | * | 7/2001 | Citrenbaum | 401/6 |

* cited by examiner

*Primary Examiner*—William C. Doerrler
(74) *Attorney, Agent, or Firm*—Norman Friedland

(57) ABSTRACT

A hand support and writing, drawing or painting instrument holder adapted to fit the hand of the user including a main body adapted to fit between the index and middle fingers and a laterally extending thumb support member for supporting the thumb of the user. A concave groove at the upper edge of the laterally extending thumb support accepts the interior of the fore finger and sleeves made from a soft material surrounds the writing, drawing or painting instrument to assure comfort to the user. The writing, drawing or painting instrument fits through a central passage in the main body and is rigidly supported therein to hold the hand spatially away from the writing surface. The movement of the arm provides the writing motion and no pinching pressure of the thumb and fingers are required. A concave groove at the bottom edge of the laterally extending thumb support is provided so that the instrument can be used by either a right or left handed person merely by inverting the instrument.

9 Claims, 3 Drawing Sheets

HAND SUPPORT AND WRITING INSTRUMENT HOLDER

TECHNICAL FIELD

This invention relates to writing support apparatus and more particularly to a support apparatus that removably holds a writing instrument so as to facilitate writing for persons that either have handicap with respect to use of hand/fingers/thumb or to obviate writing fatigue or cramps.

BACKGROUND OF THE INVENTION

While there are sundry devices shown in the prior art directed to apparatus for supporting writing instruments (pen or pencil) these devices typically require the use of a pinch or pressure which is a constraint for persons afflicted with certain ailments. Even under normal writing situations, when the amount of pressure at the tip of the thumb of the writer is minimal this force is amplified at location further away from the tip which could result in writing fatigue. As for example, a one (1) # (pound) force at the tip of the thumb will exert a 13# force at the carpal metacarpal joint and slightly less at joints therebetween. Obviously, the pain inflicted is acerbated as the writing continues in time.

This invention is directed to persons that are afflicted with a hand disability or dysfunction that is caused by any of the well known ailments or diseases including, but not limited to, age, carpal tunnel, DeQuervain's lateral epicondylitis, arthritis, multiple sclerosis, stroke, trauma, metacarpophalangeal problems, quadriplegia or any disease where there is an imbalance (increase or decrease) in muscle tone. Notwithstanding the fact that this invention is particularly efficacious for the handicapped, it nonetheless has utility for those who are not afflicted with any particular ailment. For example, one who is writing on the blackboard with chalk may find this invention easy to use and less painful. Or one who tends to get writer cramps may also find this instrument useful. Moreover, this invention has utility when other types of instruments, such as crayons, paint brushes and the like are used.

SUMMARY OF THE INVENTION

An object of this invention is to provide an instrument for aiding in writing that is characterized as removing the pressure from the fingers of the user.

A feature of this invention is a cylindrical base for vertically supporting the writing instrument and a lateral extension from the base for extending and supporting the thumb whereby the cylindrical base is located between the fore finger and index finger and is raised above the writing surface. Axial extending sleeves relative to the base that are either independent or integral with the base surround the writing instrument and are made from a soft material, such as Styrofoam that is intended to afford comfort to the user.

Another feature of this invention is that the holder is adaptable for all types of hand-writing instruments, and other instruments such as chalk, crayon, paint brushes and the like and is characterized as simple to make, easy to use and is economical in comparison to heretofore known instruments.

The foregoing and other features of the present invention will become more apparent from the following description and accompanying drawings.

Figure 1:
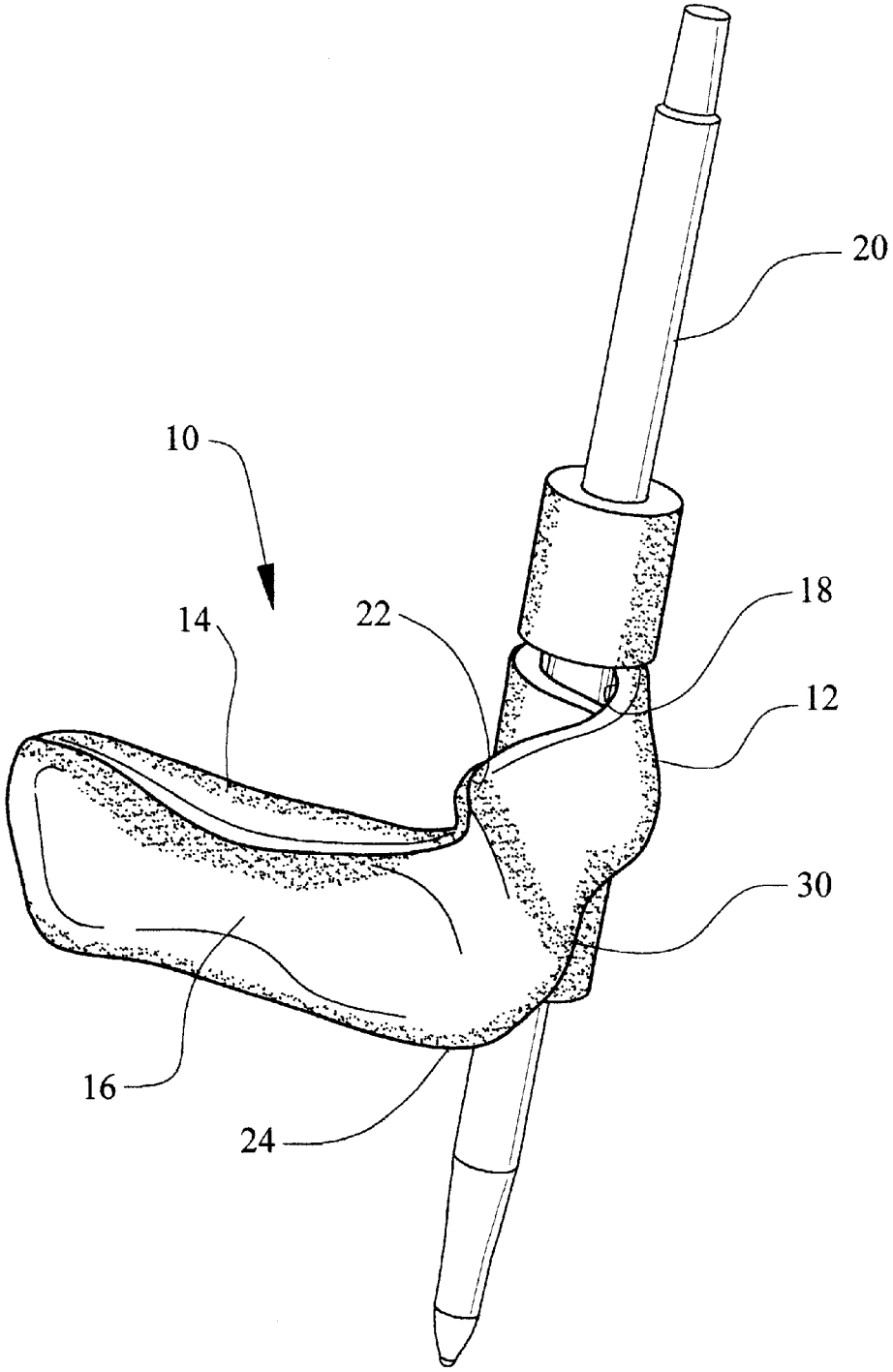
FIG. 1 is a perspective view illustrating this invention when assembled to a writing instrument.

These figures merely serve to further clarify and illustrate the present invention and are not intended to limit the scope thereof

DETAILED DESCRIPTION OF THE INVENTION

As mentioned above, while this invention is described herein as being utilized by an individual for writing or printing with a writing instrument such as a pen or pencil, it should be understood that this invention has utility for other types of devices, such a crayons, chalk, paint brushes and the like. Also, this description of the preferred embodiment discloses the invention for use by one using the right hand, it will be appreciated by one skilled in this art that the invention can be adapted for use by a person in the left hand, as well.

The invention is best seen by referring to the two Figs. which show the holding apparatus generally illustrated by reference numeral 10 that includes a generally cylindrically shaped base portion 12 and a thumb supporting portion 14. While the thumb supporting portion 14 is in the same horizontal plane relative to the remaining fingers of the writing hand, it will be appreciated that it can be either higher or lower than the plane and the unit can be customized for the user or made universal to fit many or all users. The side surface 16 of the thumb support portion is indented and contoured in a concave manner to comfortably support the thumb of the writing hand. While the unit is made from a unitary piece where the base portion is wrapped into a generally cylindrical portion, the unit, if molded would perhaps, be cylindrical and would include a central bore extending there through so as to receive a writing instrument. As shown in this embodiment, the straight through bore or passage 18 serves to hold the pen 20 with sufficient friction so that it remains in place when pressure in writing is exerted on the tip of the pen. Obviously, in this embodiment, since the holding apparatus 10 is rigid, the dimension of the central bore 18 is sized so that it accommodates the diameter of the writing instrument. In the event that it is made for universal use to accommodate different sized writing instruments or instruments, the diameter would be larger and a set screw or other type of tightening device or soft insert would be employed to accommodate different diameters. The writing tip bears against the surface of the writing material, such as paper, and holds the hand spatially away therefrom. Hence, the hand is raised above the surface of the writing material.

Adjacent to the surface 16 of the thumb support portion 14, another indent also contoured in a concave manner 22 is formed at the top therein to the interior of the 1$^{st}$ digit finger (index finger) of the writing hand. It will be appreciated from FIG. 1, that the thumb support portion includes a fore portion 25*a* and an aft portion 25*b* which is angularly disposer relative to each other and at the juncture where the fore portion 25*a* and aft portion 25*b* meet, the indent 22 at the upper edge 24 of and partially extending on the forward surface 16 of the thumb support portion 14 is located. As mentioned above, the instrument 10 can be made to accommodate a left handed person and alternatively, the right handed instrument can also be made to accommodate the left-handed person. To make the instrument universal, i.e. to accommodate the left hand as well as the right hand the instrument merely has to be inverted so that the top becomes the bottom and vice versa and the thumb support portion extends from the left index finger.

Figure 3:
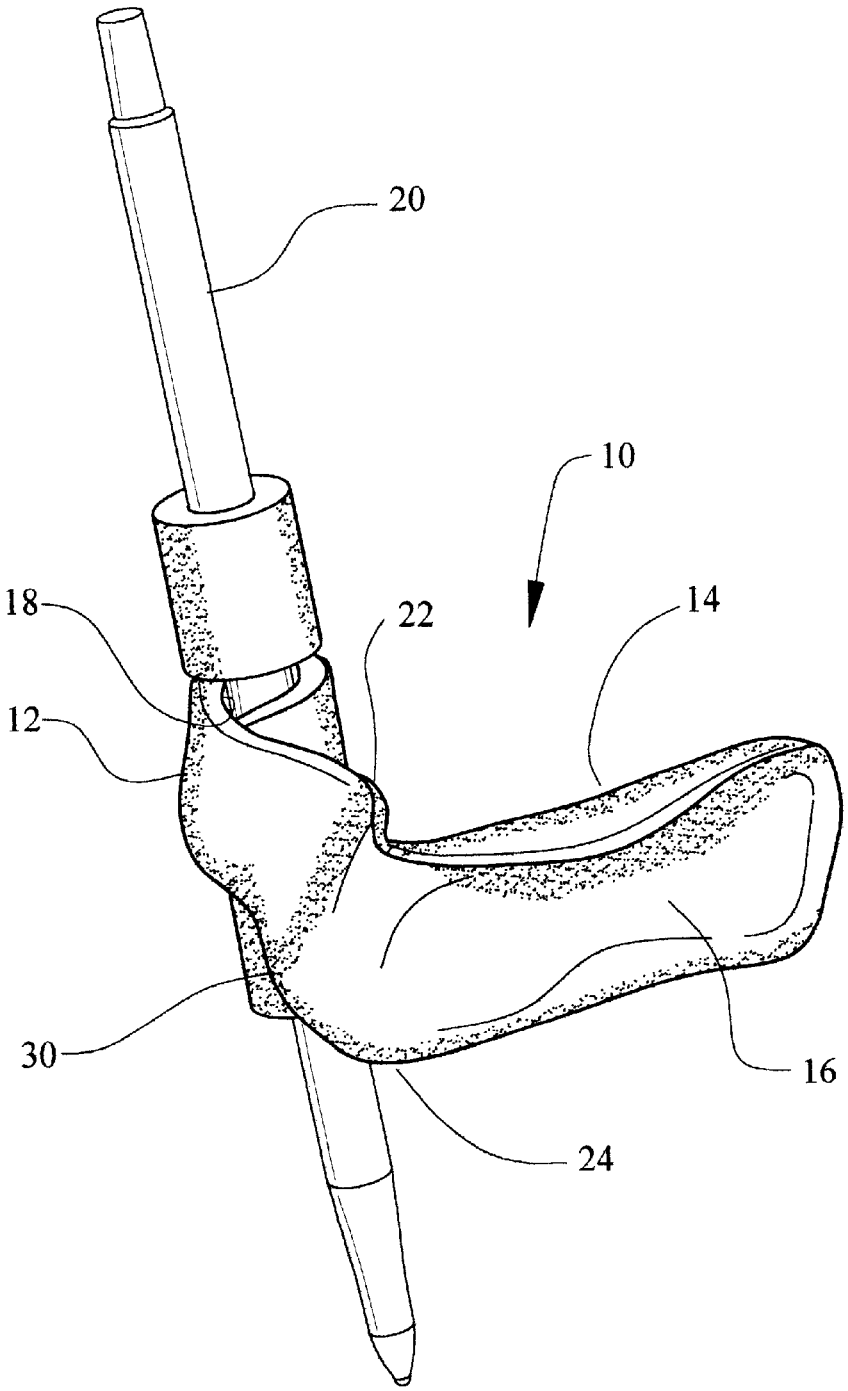
FIG. 3 is a view in perspective illustrating the invention when made for a left-handed person.

The indent 30, identical to the indent 22 is located on the bottom edge 32 of the thumb support portion 16 and likewise partially extends on the forward surface 16 and serves the same purpose. FIG. 3 is another embodiment exemplifying the invention when made for a left-handed person. All the reference numerals for the same elements are identical. It will be noted that the bottom of the support member 14 can be configured to accommodate the interior of the index finger so that the inversion of the left-handed unit can be used by a right-handed person. It will be appreciated, that it is an option to make the unit to fit a particular individual or to make the unit to be a universal model that can fit most hands, being either left or right.

A pair of sleeves 24, made from a soft material such as, plastic polymer, Styrofoam, styrene, textile fabric, rubber or the like fits over the outer surface of the writing instrument or pen 20 and is disposed adjacent the main body 12 so as to sandwich the main body 12. These sleeves serve to provide comfort to the user. Obviously, these sleeves can be made integral with the base portion 12.

Figure 2:
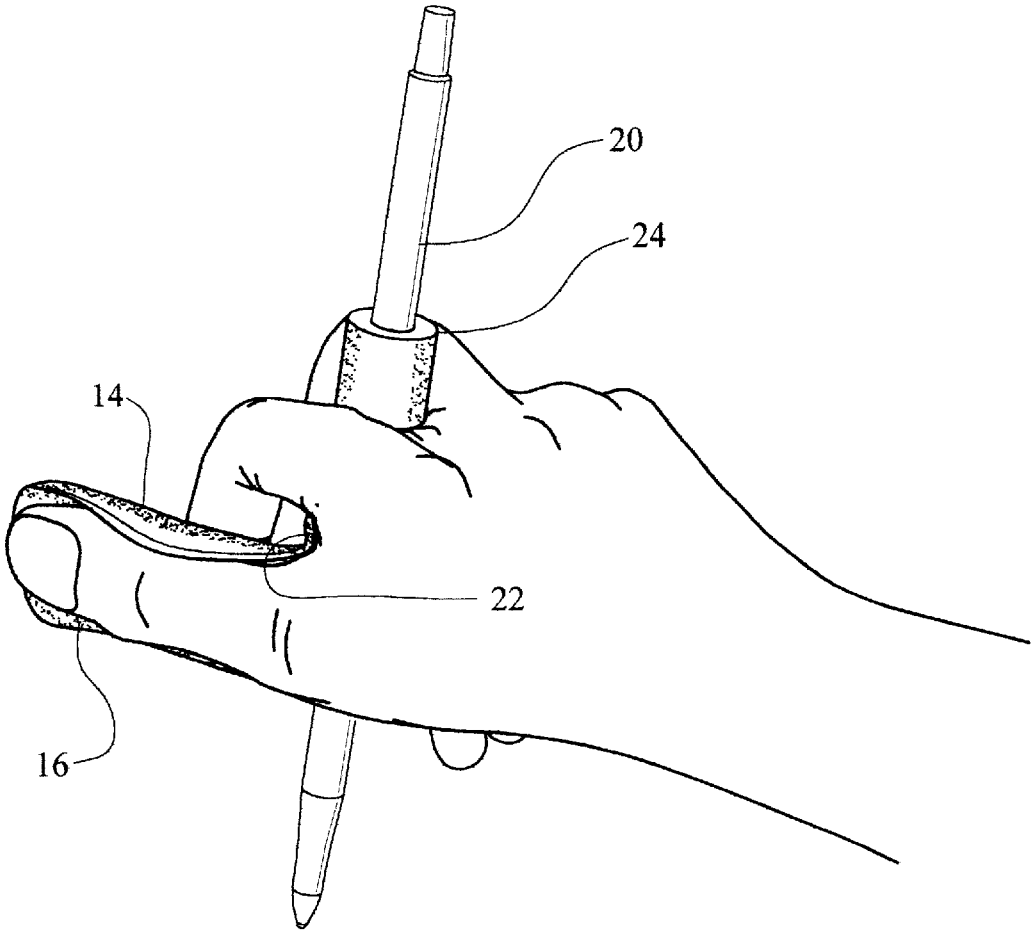
FIG. 2 is a view in perspective illustrating this invention when being used.

FIG. 2 illustrates the holding apparatus 10 when being used by a right handed person. It will be appreciated from the foregoing that the base portion is fitted between the $2^{nd}$ and $3^{rd}$ (middle finger) digit of the writing hand and the interior of the thumb and $2^{nd}$ digit of the writing hand rests in the indents or grooves 16 and 22, respectively. The pen extends below the base 12 and extends a sufficient distance to raise the hand of the user so that the arm will be comfortable as the arm moves to provide the writing motion. It will also be appreciated from the foregoing that since the thumb extends or is spread from the fingers, there are no pressures exerted by the thumb and fingers of the hand. All the motion is provided by the movement of the arm and the holding by the hand of the pen 20 is by virtue of the base portion 12 spreading or extending the distance between the $2^{nd}$ and third digits.

The invention has been made and tested and has proven to be efficacious for users that have been handicapped because of some affliction.

And what has been described is an invention that is particularly useful for the handicap and none handicap alike, while easy and comfortable to use, light in weight and economical to make.

Although this invention has been shown and described with respect to detailed embodiments thereof, it will be appreciated and understood by those skilled in the art that various changes in form and detail thereof may be made without departing from the spirit and scope of the claimed invention.

What is claimed is:

1. Apparatus for holding a tool in the hand of a human person adapted to perform writing, printing, drawing or painting, said apparatus including a main body having a pass-through aperture for receiving said tool, said tool extending past said body for contacting a surface for performing the writing, printing, drawing or painting and spatially placing the hand away from said surface, a lateral thumb support member extending from said body and having a forward facing surface for receiving the interior portion of the thumb of said hand, said main body configured to accept the hand between the $1^{st}$ digit and $2^{nd}$ digit so that motion of the arm powers said tool for performing the writing, printing, drawing or painting in response to said motion, whereby no pinching of the thumb and fingers are exerted.

2. Apparatus for holding a tool in the hand of a human person as claimed in claim 1 wherein said lateral thumb support includes a first portion affixed to the main body and a second portion angularly disposed relative to said first portion for assuring a comfortable fit between said $1^{st}$ digit and said second digit.

3. Apparatus for holding a tool in the hand of a human person as claimed in claim 2 wherein said lateral thumb support includes an upper edge portion, a groove formed in said upper edge portion at the junction between said first portion and said second portion for accepting the interior of the $1^{st}$ digit.

4. Apparatus for holding a tool in the hand of a human person as claimed in claim 3 wherein said lateral thumb support includes a lower edge portion diametrically opposed to said upper edge, a groove formed in said lower edge portion at the junction between said first portion and said second portion for accepting the interior of the $1^{st}$ digit so that said apparatus can be turned upside down and be utilized by either the left hand or the right hand.

5. The combined hand support and writing instrument holder for a right handed user having a main body having a through central bore for receiving the writing instrument and being rigidly supported therein and extending beyond said main body to engage the writing surface and spatially support the hand away from the writing surface, a thumb supporting portion extending from said main body and in a direction away from the $1^{st}$ digit having a forward concave contoured face for receiving the interior of the right thumb of the hand of the user, said thumb supporting portion including a forward portion and an aft portion angularly disposed relative to each other, said thumb supporting portion including an upper edge and a concave groove formed thereon at the junction of the fore portion and aft portion for receiving the interior of the index finger of the user, and a sleeve surrounding said writing instrument adjacent said main body for fitting between the $1^{st}$ digit and $2^{nd}$ digit of the user whereby the motion of the arm of the user imparts the writing motion to the writing instrument without utilizing any pinching force of the user.

6. The combined hand support and writing instrument holder for a right handed user as claimed in claim 5 including another sleeve surrounding said writing instrument mounted in proximity to said main body for sandwiching said main body between said sleeve and said another sleeve.

7. The combined hand support and writing instrument holder for a right handed user as claimed in claim 6 wherein said sleeve is made from a soft material taken from the group consisting essentially of plastic polymer, Styrofoam, styrene, textile fabric, or rubber.

8. The combined hand support and writing instrument holder for a left handed user having a main body having a through central bore for receiving the writing instrument and being rigidly supported therein and extending beyond said main body to engage the writing surface and spatially support the hand away from the writing surface, a thumb supporting portion extending from said main body and in a direction away from the $1^{st}$ digit having a forward concave contoured face for receiving the interior of the left thumb of the hand of the user, said thumb supporting portion including a forward portion and an aft portion angularly disposed relative to each other, said thumb supporting portion including an upper edge and a concave groove formed thereon at the junction of the fore portion and aft portion for receiving the interior of the left index finger of the user, and a sleeve surrounding said writing instrument adjacent said main body for fitting between the $1^{st}$ digit and $2^{nd}$ digit of the user whereby the motion of the arm of the user imparts the writing motion to the writing instrument without utilizing any pinching force of the user.

9. The combined hand support and writing instrument holder for a right handed or left handed user having a main body having a through central bore for receiving the writing instrument and being rigidly supported therein and extending beyond said main body to engage the writing surface and spatially support the hand away from the writing surface, a thumb supporting portion extending from said main body and in a direction away from the $1^{st}$ digit having a forward concave contoured face for receiving the interior of the either the right or left thumb of the hand of the user, said thumb supporting portion including a forward portion and an aft portion angularly disposed relative to each other, said thumb supporting portion including an upper edge and a lower edge, a concave groove formed on the upper edge at the junction of the fore portion and aft portion for receiving the interior of the right index finger of the user, a concave groove formed on said lower edge at the junction of the fore portion and aft portion for receiving the interior of the left index finger of the user, and an upper sleeve and a lower sleeve surrounding said writing instrument adjacent said main body for fitting between the $1^{st}$ digit and $2^{nd}$ digit of the user whereby the motion of the arm of the user imparts the writing motion to the writing instrument without utilizing any pinching force of the user and said combined hand support and writing instrument holder capable of being turned upside down for accommodating a right hand user and a left hand user.

* * * * *